United States Patent [19]

Obal

[11] Patent Number: 4,856,564

[45] Date of Patent: Aug. 15, 1989

[54] INDICATOR ASSEMBLY

[76] Inventor: Michael S. Obal, 2596 E. 2nd Ave., Vancouver, British Columbia, Canada, V5N 1C6

[21] Appl. No.: 165,237

[22] Filed: Mar. 7, 1988

[51] Int. Cl.[4] ..... B67D 5/00

[52] U.S. Cl. ..... 141/95; 141/86; 141/199; 116/70; 116/109; 220/86 R

[58] Field of Search ..... 141/83, 94, 95, 96, 141/86, 301, 302, 303, 199, 216; 116/109, 70, DIG. 25; 220/86 R, 85 F, 85 R

[56] References Cited

U.S. PATENT DOCUMENTS

| | | | |
|---|---|---|---|
| 2,353,181 | 7/1944 | Neef, Jr. | 116/109 |
| 2,360,338 | 10/1944 | Hammond | 116/109 |
| 2,391,040 | 12/1945 | Scully | 116/109 X |
| 2,441,872 | 5/1948 | Di Renzo | 116/109 |
| 2,548,734 | 4/1957 | Mathey | 220/86 R |
| 2,831,452 | 4/1958 | Haynes | 116/109 X |
| 2,935,099 | 5/1960 | Haynes | 141/95 |
| 3,136,295 | 6/1964 | Gramo | 116/109 X |
| 3,548,779 | 6/1969 | Green | 116/309 |
| 3,814,147 | 6/1974 | Lindberg | 141/94 |
| 4,011,828 | 3/1977 | Black | 116/70 |
| 4,083,387 | 9/1976 | Stieber et al. | 141/95 |
| 4,134,358 | 1/1979 | Heermans | 116/70 |
| 4,176,694 | 12/1979 | Dickerson | 141/95 |
| 4,202,386 | 5/1980 | Orr | 141/300 |
| 4,263,868 | 4/1981 | Fukui | 116/70 |
| 4,278,115 | 7/1981 | Briles et al. | 141/86 |
| 4,706,718 | 11/1987 | Milo | 141/86 |
| 4,749,009 | 1/1988 | Faeth | 141/45 |

FOREIGN PATENT DOCUMENTS

| | | | |
|---|---|---|---|
| 402637 | 5/1966 | Switzerland | 141/303 |

*Primary Examiner*—Ernest G. Cusick

*Attorney, Agent, or Firm*—Bull, Housser & Tupper

[57] ABSTRACT

An indicator assembly generates a sound when a liquid is flowing through a fill conduit for a storage tank. The assembly has a body with a first connection device for connection with the fill conduit, and has a second connection device for connection to the storage tank. There is a passageway for liquid which extends between the first and second connection devices. An aspirator has an outer opening outside the body which communicates with an inner opening positioned to contact liquid flowing through the passageway from the fill conduit. A sound generator generates a sound with a flow of air therethrough. The sound generator is connected to the outer end of the aspirator so that, when liquid flows through the passageway for liquid, air is drawn through the aspirator from the storage tank, and the sound generator generates sounds.

29 Claims, 5 Drawing Sheets

INDICATOR ASSEMBLY

FIELD OF THE INVENTION

This invention relates to an audible signaling device which sounds while a container for liquids is being filled, and ceases to sound when the container is full.

BACKGROUND OF THE INVENTION

It is difficult to readily determine whether an underground storage tank has been filled from a delivery vehicle. This is particularly true for sealed tanks wherein the delivery conduit is tightly fitted onto the inlet for the storage tank by a threaded coupling or the like.

A number of devices have been developed in the past to signal the operator when an underground storage tank is full. For example, U.S. Pat. No. 4,083,387 to Stieber shows a system for filling a storage tank in which the tank is provided with a sound transmitting device which is activated when the fluid reaches the level of the sound transmitting device. The system is relatively complicated including a microphone, amplifier and other electronic components. Some of these components are relatively fragile, and thus may not be well suited for the environment.

U.S. Pat. No. 4,176,694 to Dickerson shows an automatic shut-off liquid dispensing valve wherein audible means are provided to indicate that the tank is being filled. The audible means ceases when the tank is full. This audible means is in the nature of a gurgling sound.

U.S. Pat. No. 2,935,099 to Haynes relates to a signalling device for a filler pipe. Its whistle sounds until the liquid covers the inlet tube.

U.S. Pat. No. 3,548,779 to Green discloses a liquid signalling device whereby air exiting from the tank enters the opening of a tube and creates a whistling noise as it emerges from the opening. When the opening is covered, the sound stops.

All of the devices shown in these patents, with the exception of the Green device, are for use with pressurized delivery hoses. They are not adapted for use with gravity fed hoses. The Green device could be used with gravity fed hoses, but it appears that the underground tank would have to be specially modified.

An object of the invention is to provide a flow indicator for an underground storage tank suitable for use with gravity fed delivery hoses.

It is also an object of the invention to provide a device which does not require the discharge of polluting, vapour containing air from the device in order to make the audible sound.

It is also an object of the invention to provide a device of the type which does not require electronic components, and is relatively economical and rugged in construction.

SUMMARY OF THE INVENTION

The invention provides as indicator assembly for generating a sound when a liquid is flowing through a fill conduit for a storage tank. The assembly includes a body having a first connection means for connection with the fill conduit and second connection means for connection to the storage tank. There is a passageway for liquid extending between the first and second connection means. An aspirator has an outer opening outside said body which communicates with an inner opening positioned to contact liquid flowing through the passageway from the fill conduit. There is sound generating means for generating a sound with a flow of air therethrough. The sound generating means is connected to the outer end of the aspirator so that when liquid flows through the passageway for liquid air is drawn through the aspirator and the sound generating means to generate said sound.

DESCRIPTION OF THE PREFERRED EMBODIMENT

Figure 1:
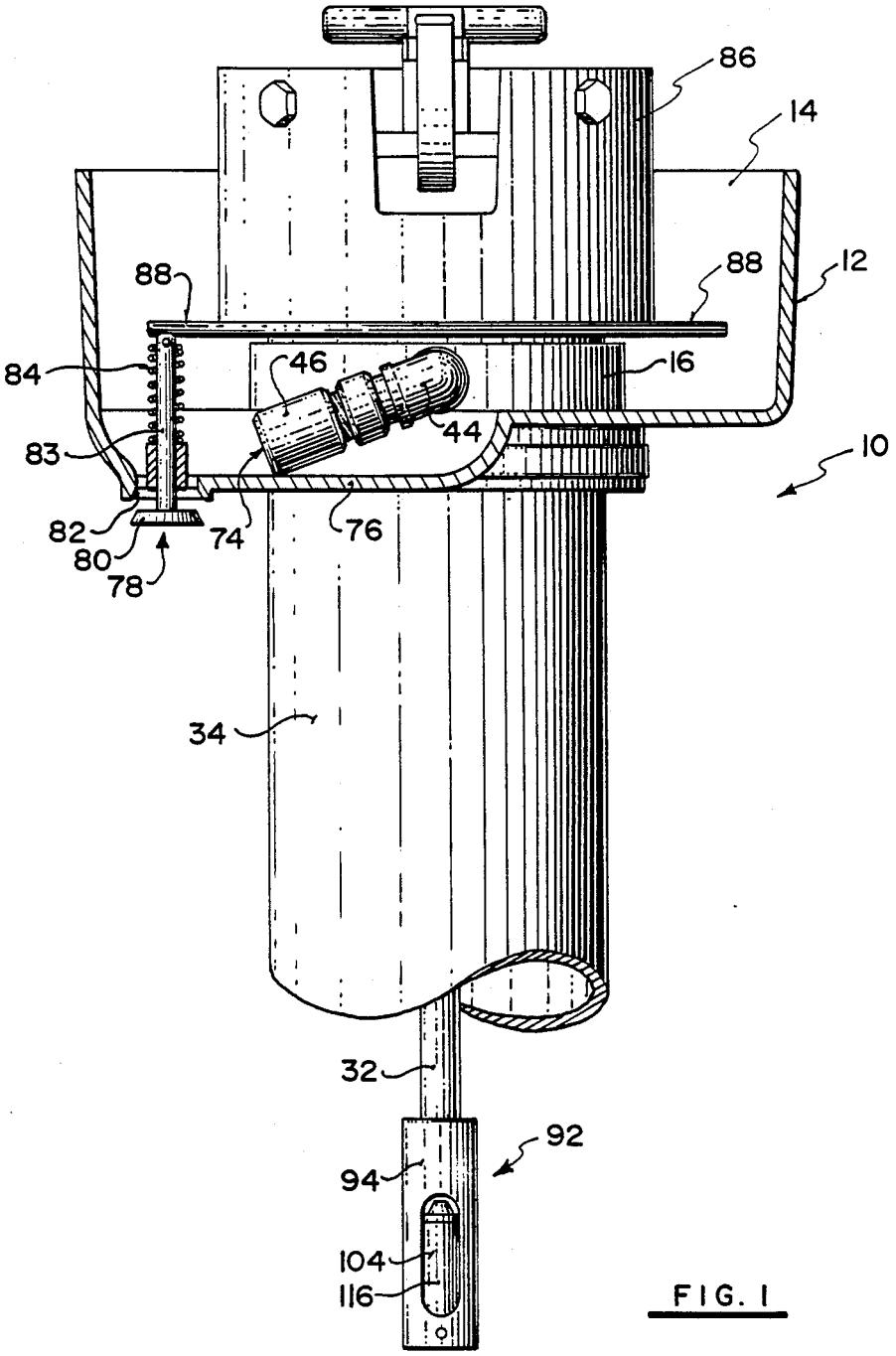
FIG. 1 is a side elevational view, partly in section, of an indicator assembly for generating a sound when a liquid is flowing through a fill conduit for a storage tank.
Figure 2:
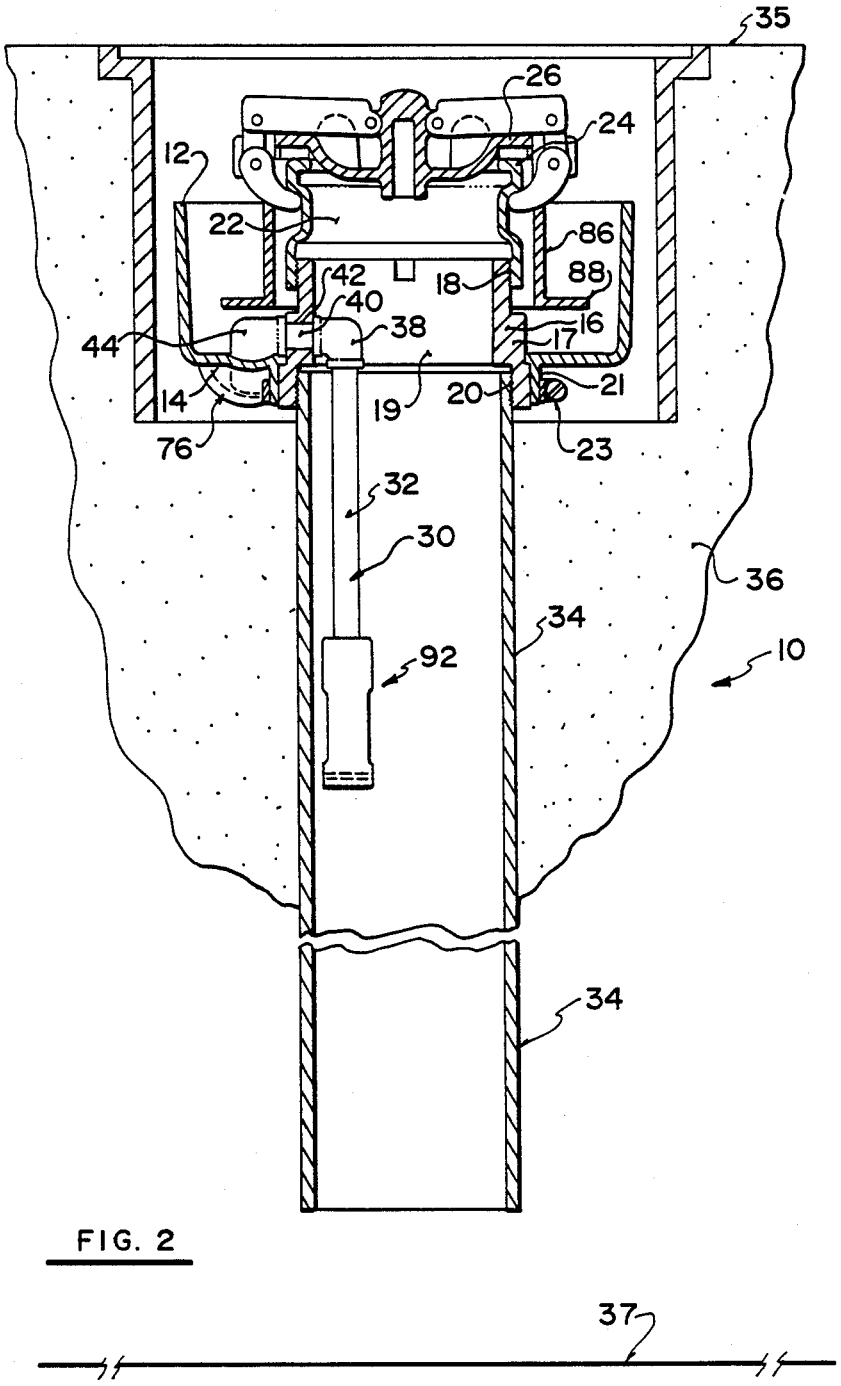
FIG. 2 is a fragmentary, sectional view of the indicatoro assembly installed on the inlet pipe of a storage tank.

Referring to FIG. 1, this shows an indicator assembly which is used to generate a sound when a liquid is flowing through a fill conduit for a storage tank. The drawing shows assembly 10 in elevation apart from upwardly extending, annular flange 12 which is shown in section, and which forms part of an open topped container 14 for receiving spilled liquids. Referring to FIG. 2, flange 12 extends about a body 16 which is ring-shaped, having a central passageway 19. The body 16 includes a sleeve 17 having an upper threaded portion 18, and a lower threaded portion 20. Portion 18 has outer threads for threadedly engaging corresponding iner threads of a collar 22. The collar 22 has a flange 24 at teh top thereof adapted to normally engage a conventtional cap 26. When the storage tank is being filled, the cap is removed and replaced with a filling conduit which engages flange 24 in a manner similar to the cap. collar 22 acts as first connecting means for connecting to a delivery conduit. Portion 20 has inner threads for engaging corresponding threads on the top of vertical fill pipe 34 which extends downwardly from top 35 of an underground storage tank 36 to near the bottom 37 thereof. The sleeve 17 and portion 20 act as second connection means for connection to the fill conduit for the storage tank. The container 14 has a lip 21 which fits over a portion of the sleeve 17 enabling a clamp 23 to be used to secure the container to the body 16.

The assembly includes an aspirator 30 which includes a pipe 32 extending within and parallel to fill pipe 34. There is an nelbow 38 at the top of pipe 32 which is connected by a short section of pipe 40 extending through aperture 42 in the wall of sleeve 17 to a second elbow 44. The end of elbow 44 distal pipe 40 is angled downwardly as shown in FIG. 1, and is connected to a sound generating device in the form of whistle 46 as shown in FIG. 1.

Figure 4:
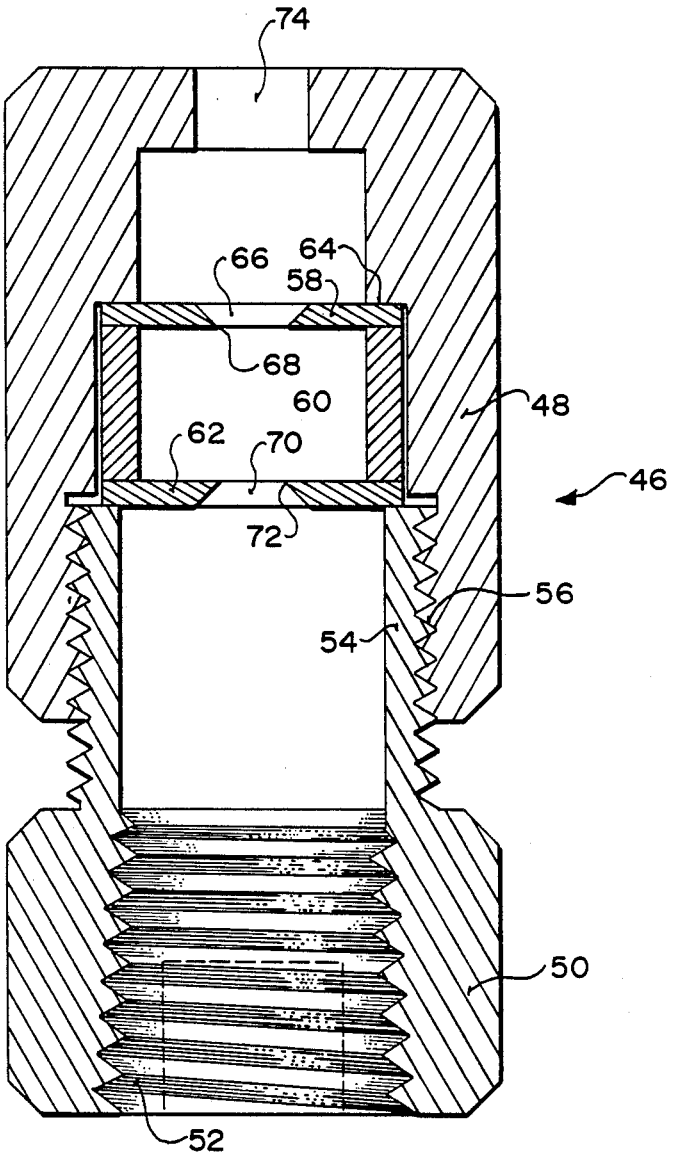
FIG. 4 is a longitudinal section of the sound generating whistle for the assembly.

Whistle 46 is shown in better detail in FIG. 4. It includes two threadedly engaged members 48 and 50. Member 50 has an inner thread 52 for connection to elbow 44 and an outer threaded portion 54 which engages complementary threads 56 of member 48. A first apertured disc 58, a spacer 60 and a second apertured disc 62 are tightly received between member 50 and shoulder 64 of member 48. Disc 58 has an inner aperture 66 with angled walls, forming a sharp annular edge 68. Disc 62 has a similar aperture 70 with an angled inner wall, providing an inner sharp edge 72 whereabout. Member 48 has an aperture 74 in the center thereof opposite member 50. Discs 58 and 62 and the apertures 66 and 70 therein are configured to produce an audible whistling sound when air is drawn through aperture 74, and through members 48 and 50.

Referring to FIGS. 1 and 2, it may be seen that container 14 has a depression 76 in the bottom thereof, wherein open end 74 of member 48 is located. There is a drain valve 78 in the bottom of the container within the depression 76. The valve includes a disc 80 normally spaced below a valve seat 82 forming an aperture in the bottom of depression 76. The valve disc is connected to a valve stem 83, and is biased upwardly to contact valve seat 82 by a valve spring 84. The cap 26 has a ring 86 having a bottom flange 88 extending about the body 16 as shown in FIGS. 1 and 2. As shown in FIG. 1, the bottom of flange 88 contatcts the top of valve stem 83 when cap 26 is in place. Thus, when ring 86 is pushed downwardly by cap 26 the valve is open, and when the cap is removed and the ring is released, spring 84 closes the valve 78.

Figure 3:
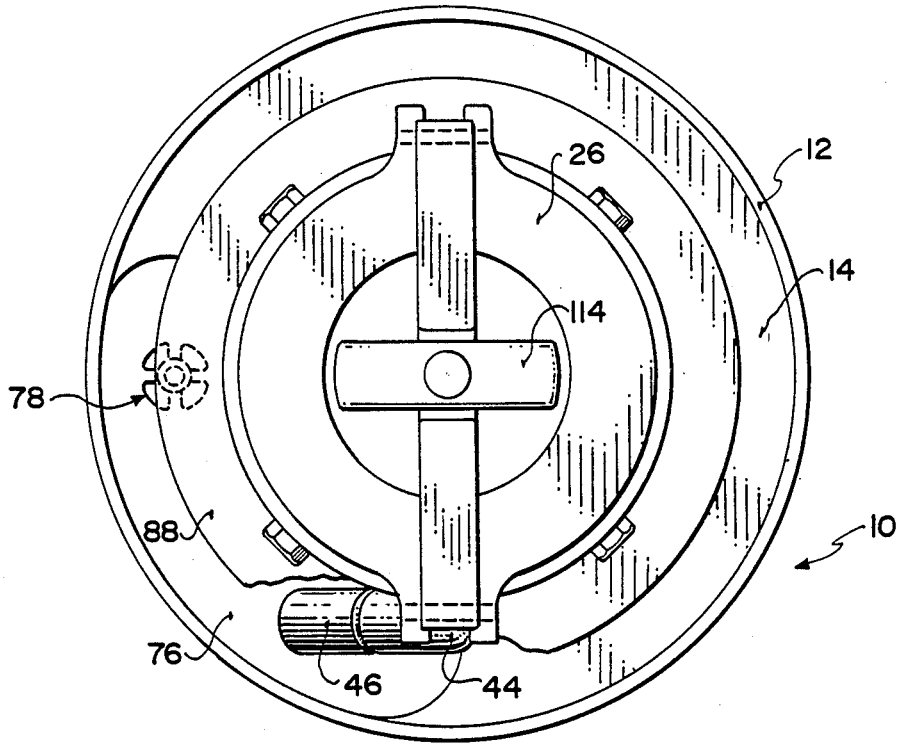
FIG. 3 is a top plan view of the indicator assembly.
Figure 5:
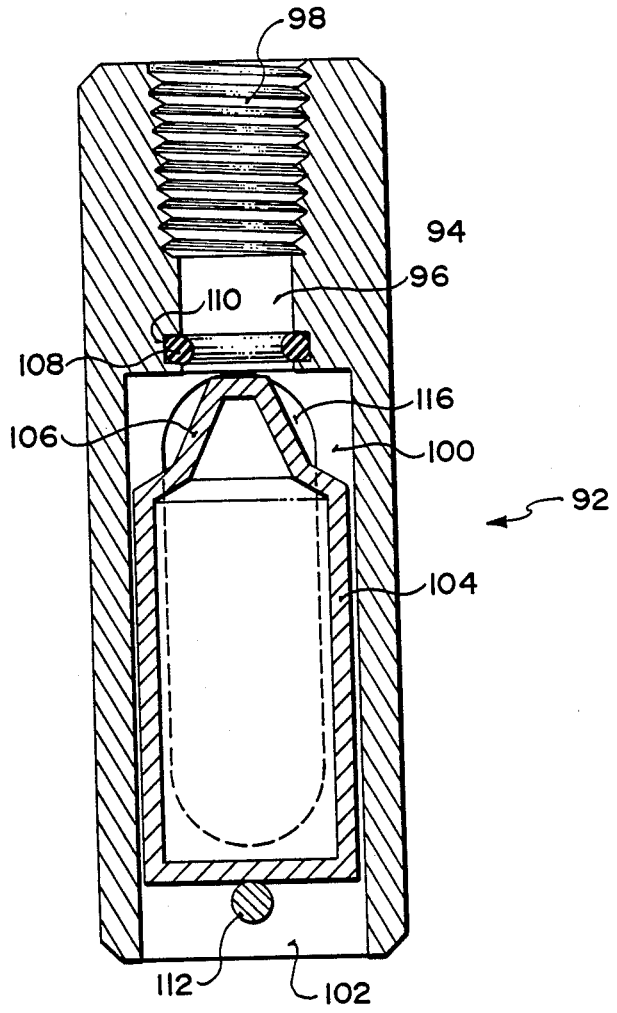
FIG. 5 is a longitudinal section of the float valve of the assembly.

There is a float valve assembly 92 at the bottom end of pipe 32 as shown in FIGS. 1 and 3. As shown in detail on FIG. 5, the valve includes a cylindrical body 94 having a relatively narrow bore 96 at the upper end thereof, which has a threaded portion 98. Bore 96 communicates downwardly with a wider bore 100, which extends through the body to open bottom end 102. There is a hollow, generally cylindricl float 104 slideably received in bore 100. The float has a truncated conical projection 106 on the top which tapers towards bore 96. An O-ringn 108 is received within an annular groove 110 near the bottom of bore 96, and seres as a seat for conical portion 106 which acts as a valve member. A peg-like projection 112 extends across bore 100 and serves to limit downward movement of the float.

OPERATION

In normal operation, the assembly 10 is positioned as shown in FIGS. 1 and 2 with the cap 26 in place. When the delivery person arrives at the site of the underground storage tank, valve 78 is held open by flange 88 to prevent water from accumulating in container 14. The valve is thenclosed when the cap 26 and the attached ring 86 and flange 88 are removed in the conventional mlanner utilizing handle 114 shown in FIG. 3. Once this has been done, the end of the delivery hose is clamped on collar 22 in place of the cap. Any spillage that occurs is held within container 14.

The liquid being delivered, typically a pertroleum product such as gasoline, is fed into the assembly by the delivery hose by gravity feed. The flowing liquid enters passageway 19 of body 16 which is located between collar 22 and the lower threaded portion 20. The liquid then flows downwardly through fill pipe 34 of the tank. Float valve assembly 92 on the end of aspirator 30 is located within the stream of liquid which flows downwardly through fill pipe 34. This creates a suction within the aspirator, tending to draw fluid through aperture 74, shown in FIG. 1, and into fill pipe 34. Normally float 104 is in the position shown in FIG. 5, thus permitting the fluid to be drawn about the float through recess 116 shown in FIG. 5.

Initially, the fluid drawn through the aspirator may be any liquid spilled into container 14 which is emptied because of the location of aperture 74 within the depression 76. Once container 14 has been emptied, the fluid drawn through is air from the ambient atmosphere. This air being drawn through whistle 46 creates an audible sound, indicating that liquid is flowing from the delivery vehicle and through fill pipe 34.

When the tank is full, the liquid rises in nfill pipe 34 until it contacts float 104. This causes the float to rise such that projection 106 contacts O-ring 108, closing off aspirator 30. Thus liquid cannot flow upwardly through the aspirator to exit through aperture 74. At the same time, the sealing of projection 106 on O-ring 108 stops the flow of air inwardly through whistle 46. Consequently, the audible sound stops, indicating that the tank is full.

It should be understood that many of the details provided above are by way of example only. Modifications are possible within the scope of the invention, which is to be interpreted with reference to the following claims.

What is claimed is:

1. An indicator assembly for generating a sound when a liquid is flowing through a fill conduit for a storage tank, the assembly comprising:

(a) a body having first connection means for connection to a delivery conduit, second connection means for connection to the fill conduit for the storage tank, and a passageway for liquid extending between the first connection means and the second connection means;

(b) an open container connected to said body to receive liquid spilled in the vicinity of the body;

(c) an aspirator having an outer opening outside said body communicating with an inner opening positioned on the assembly to contact liquid flowing from the delivery conduit when the assembly is installed on the tank, the outer opening being disposed inside said container to draw liquid from said container into the fill conduit; and (d) sound generating means for generating a sound when air flows therethrough, the sound generating means being connected to the outer opening of said aspirator so that, when the liquid flows through the passageway for liquid, air is drawn through the aspirator and said sound generating means to generate said sound.

2. An indicator assembly as claimed in claim 1, further including means operatively connected to said aspirator for stopping a flow of liquid towards the outer opening thereof.

3. An indicator as claimed in claim 2, wherein the means operatively connected to the aspirator is a float valve.

4. An indicator assembly as claimed in claim 3, wherein the float valve includes a valve housing having a first end and a second end, the first end being connected to the aspirator, a valve seat near the first end, the second end of the valve housing being open, and a floatable valve member within the housing having a tapered end adjacent the valve seat and receivable thereby to stop a flow of fluid through the aspirator.

5. An indicator assembly as claimed in claim 1, wherein the sound generating means includes a first restrictor having an opening with a sharp annular edge.

6. An indicator assembly as claimed in claim 5, wherein the sound generating means includes a second restrictor having an opening with a sharp annular edge, and being spaced-apart from the first restrictor.

7. An indicator assembly as claimed in claim 6, wherein the first restrictor and the second restrictor are apertured discs.

8. An indicator asesmbly as claimed in claim 1, wherein said second connection means includes an annular member having a threaded aperture therein.

9. An indicator assembly as claimed in claim 8, wherein the body has an annular flange extending there around, defining said open container for liquid.

10. An indicator assembly as claimed in claim 9, wherein said sound generating means is within said container.

11. An indicator assembly as claimed in claim 10, wherein the container has a depression therein, the sound generating means having an outer opening for air within said depression.

12. An indicator assembly as claimed in claim 9, further including a drain valve near the bottom of said container.

13. An indicator assembly as claimed in claim 12, further including means for opening the drain valve whenthe cap engages the annular member.

14. An indicator assembly as claimed in claim 8, further comprising a cap which is sealingly engagable with the annular member.

15. A combination of a storage tank having a vertical fill conduit extending downwardly from the top thereof and an indicator assembly for generating a sound when a liquid is flowing through the fill conduit, the assembly being connected to the fill conduit and comprising:

(a) a body having first connection means for connection to a delivery conduit, second connection means for connection to the fill conduit for the storage tank, and a passageway for liquid extending between the first connection means and the second connection means;

(b) an open container connected to said body to receive liquid spilled in the vicinity of the body;

(c) an aspirator having an outer opening outside said body communicating with an inner opening positioned within the fill conduit to contact liquid flowing through the fill conduit from the delivery conduit, the outer opening being disposed inside said container to draw liquid from said container into the fill conduit; and (d) sound generating means for generating a sound when air flows therethrough, the sound generating means being connected to the outer opening of said aspirator so that, when the liquid flows through the passageway for liquid, air is drawn through the aspirator and said sound generating means to generate said sound.

16. A combination assembly as claimed in claim 15, further including means operatively connected to said aspirator for stopping a flow of liquid towards the outer opening thereof.

17. A combination as claimed in claim 16, wherein the means operatively connected to the aspirator is a float valve.

18. A combination as claimed in claim 17, wherein the float valve includes a valve housing having a first end and a second end, the first end being connected to the aspirator, a valve seat near the first end, the second end of the valve housing being open, and a floatable valve member within the housing having a tapered end adjacent the valve seat and receivable thereby to stop a flow of fluid through the aspirator.

19. A combination as claimed in claim 15, wherein the sound generating means includes a first restrictor having an opening with a sharp annular edge.

20. A combination as claimed in claim 19, wherein the sound generating means includes a second restrictor having an opening with a sharp annular edge, and being spaced-apart from the first restrictor.

21. A combination as claimed in claim 20, wherein the first restrictor and the second restrictor are apertured discs.

22. A combination as claimed in claim 15, wherein said second connection means includes an annular member having a threaded aperture therein.

23. A combination as claimed in claim 22, further comprising a cap which is sealingly engagable with the annular member.

24. A combination as claimed in claim 15, wherein the body has an annular flange extending there around, defining said open container for liquid.

25. A combination as claimed in claim 24, wherein said sound generating means is within said container.

26. A combination as claimed in claim 25, wherein the container has a depression therein, the sound generating means having an outer opening for air within said depression.

27. A combination as claimed in claim 24, further including a drain valve near the bottom of said container.

28. A combination as claimed in claim 27, further including means for opening the drain valve when the cap engages the annular member.

29. A combination as claimed in claim 15, wherein the tank has a bottom and the fill conduit extends to near the bottom of the tank.

* * * * *